US006748760B1

(12) United States Patent
Cheng

(10) Patent No.: US 6,748,760 B1
(45) Date of Patent: Jun. 15, 2004

(54) AIR CONDITIONING APPARATUS OF A HYPERBARIC OXYGEN CHAMBER

(76) Inventor: Kuo-Chung Cheng, No. 9, Lane 12, Guang Feng 1st Street, Ba-De City, Tao Yuan County (TW)

( * ) Notice: Subject to any disclaimer, the term of this patent is extended or adjusted under 35 U.S.C. 154(b) by 0 days.

(21) Appl. No.: 10/425,656

(22) Filed: Apr. 30, 2003

(51) Int. Cl.[7] ..... F25D 17/04
(52) U.S. Cl. ..... 62/408; 62/411
(58) Field of Search ..... 62/408, 407, 409, 62/410, 411

(56) References Cited

U.S. PATENT DOCUMENTS 3,255,751 A * 6/1966 Bouet ..... 128/205.26
3,587,574 A * 6/1971 Mercer ..... 128/205.26
3,807,396 A * 4/1974 Fischel ..... 128/201.21
4,227,524 A * 10/1980 Galerne ..... 128/205.26
5,327,904 A * 7/1994 Hannum ..... 128/205.26
6,016,803 A * 1/2000 Volberg et al. ..... 128/205.26

* cited by examiner

*Primary Examiner*—Melvin Jones
(74) *Attorney, Agent, or Firm*—Rosenberg, Klein & Lee

(57) ABSTRACT

An air conditioning apparatus is provided to a hyperbaric oxygen chamber; the air conditioning apparatus being disposed inside the hyperbaric oxygen chamber, and comprising an air-actuated revolving member for making an axial flow fan thereof revolve so as to force air inside the chamber to travel through a cooling device thereof; thus, the temperature of air inside the chamber is maintained at a comfortably low level, and air circulation is enhanced for the users of the chamber.

1 Claim, 4 Drawing Sheets

AIR CONDITIONING APPARATUS OF A HYPERBARIC OXYGEN CHAMBER

BACKGROUND OF THE INVENTION

1. Field of the invention

The present invention relates to an air conditioning apparatus of a hyperbaric oxygen chamber, which is used for helping pressured air inside the chamber remain at lower temperature so that people will not feel too hot when receiving service in the chamber.

2. Brief Description of the Prior Art

Hyperbaric oxygen therapy is a treatment in which patients, e.g. those suffering from caisson disease, breathes high concentration oxygen while lying or seated in a large chamber. Because oxygen is relatively expensive and combustible, it will be a waste of money and dangerous to fill the chamber with hyperbaric oxygen, and a chamber is used to provide a sealed space, into which pressured air is fed, and people receiving therapy breathe high concentration oxygen supplied to them via hoods or respirators, which are worn on them. In the light of the fact that some high concentration oxygen can leak into a hyperbaric chamber from a hood used in the chamber in therapy, conventional hyperbaric chambers are not equipped with other electric devices therein lest sparks of electric devices should cause gas in the chamber to explode. Consequently, the temperature of air inside a sealed hyperbaric chamber will become uncomfortably hot because of lack of cooling devices.

Referring to FIG. 4, a cooling device 33 is provided for overcoming the above disadvantage. The cooling device 33 is connected to an appropriate portion of an air inlet pipe 32 of a hyperbaric chamber 31. When pressured air is being supplied into the chamber 31 via the inlet pipe 32, it will first travel through the cooling device 33, and the temperature thereof is reduced. Thus, air is cooler when being supplied into the chamber 31.

However, because air will no longer be supplied through the cooling device 33 into the chamber 31 as soon as air pressure inside the chamber 31 has reached certain level, supply of cool air is limited to early stage of use of the chamber 31. In other words, the temperature inside the chamber 31 will still become higher and higher on the later stage of the course of the chamber 31 being used, causing the users to feel uncomfortable.

SUMMARY OF THE INVENTION

It is a main object of the present invention to provide an air conditioning apparatus to the hyperbaric oxygen chamber, which can function to make air cool throughout use of the chamber. The air conditioning apparatus is disposed inside the chamber, and has an air-actuated revolving member for making an axial flow fan revolve so as to force air inside the chamber to travel through a cooling device; thus, the temperature of air inside the chamber is maintained at a comfortably low level, and air circulation is enhanced for the users of the chamber. Because the revolving member is actuated by air pressure, it will not produce sparks to cause high concentration oxygen to explode.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
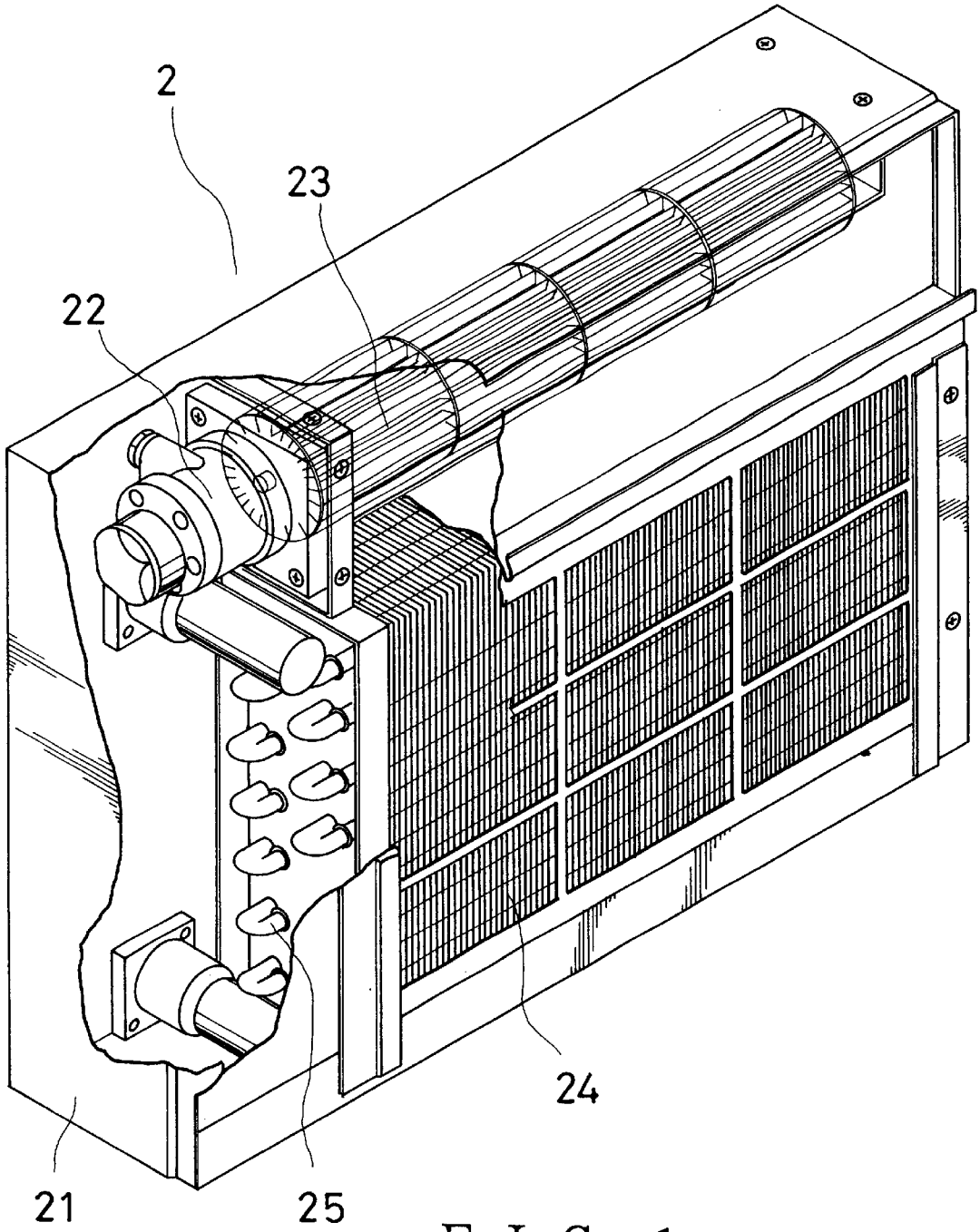
FIG. 1 is a view showing the structure of an air conditioning apparatus of a hyperbaric oxygen chamber according to the present invention.
Figure 2:
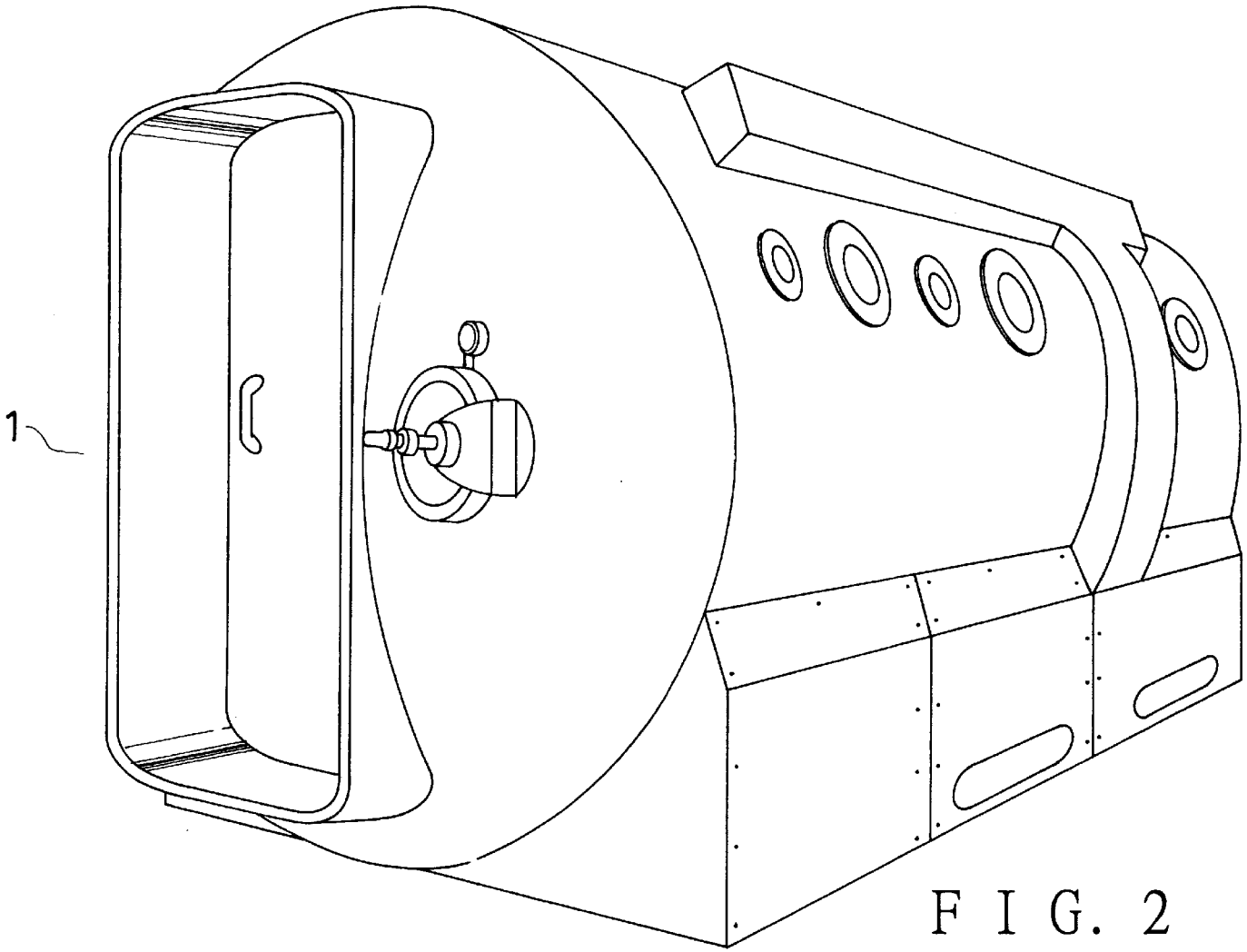
FIG. 2 is a perspective view of a hyperbaric oxygen chamber according to the present invention.
Figure 3:
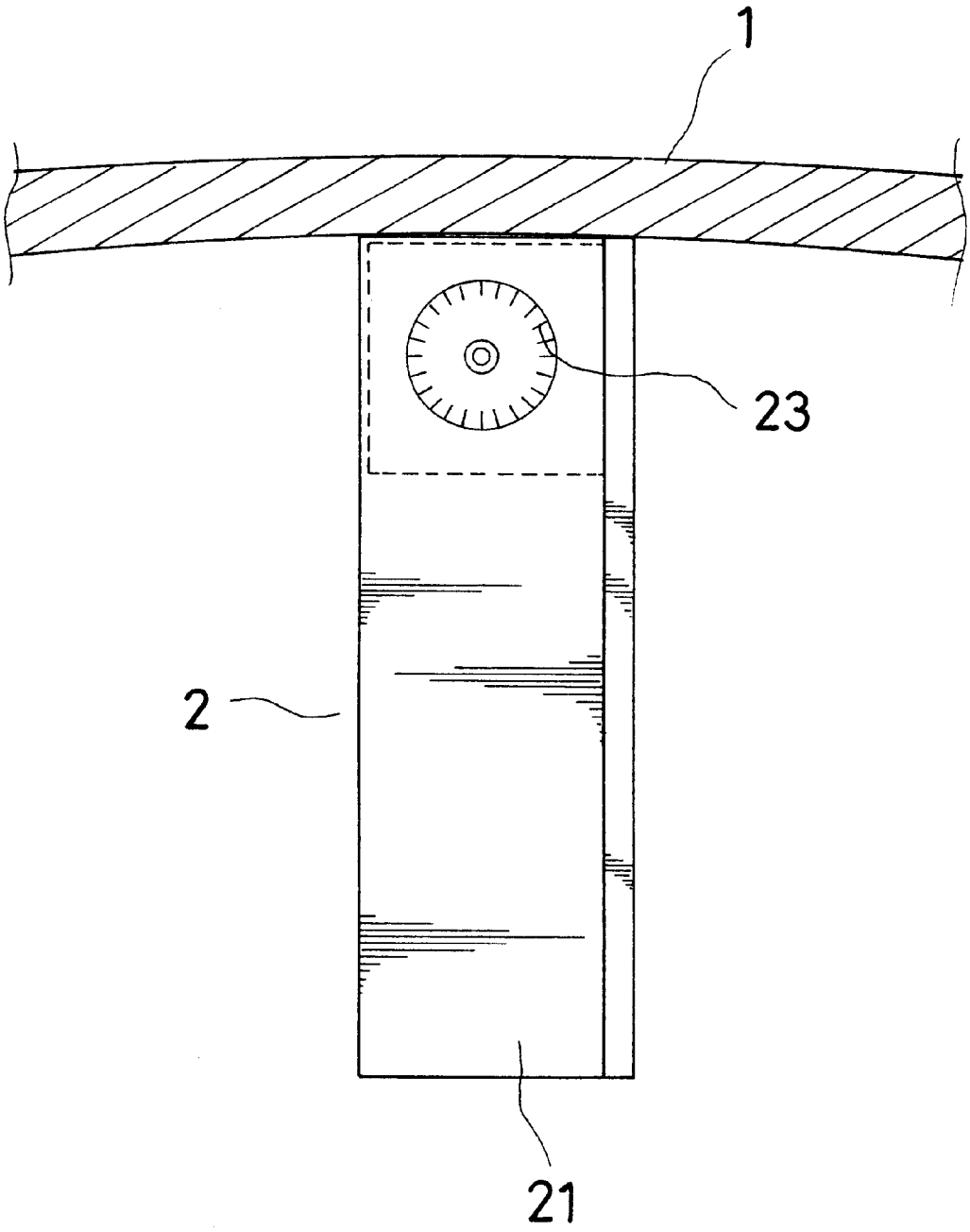
FIG. 3 is a view showing the present air conditioning apparatus in respect of the position thereof relative to the chamber.
Figure 4:
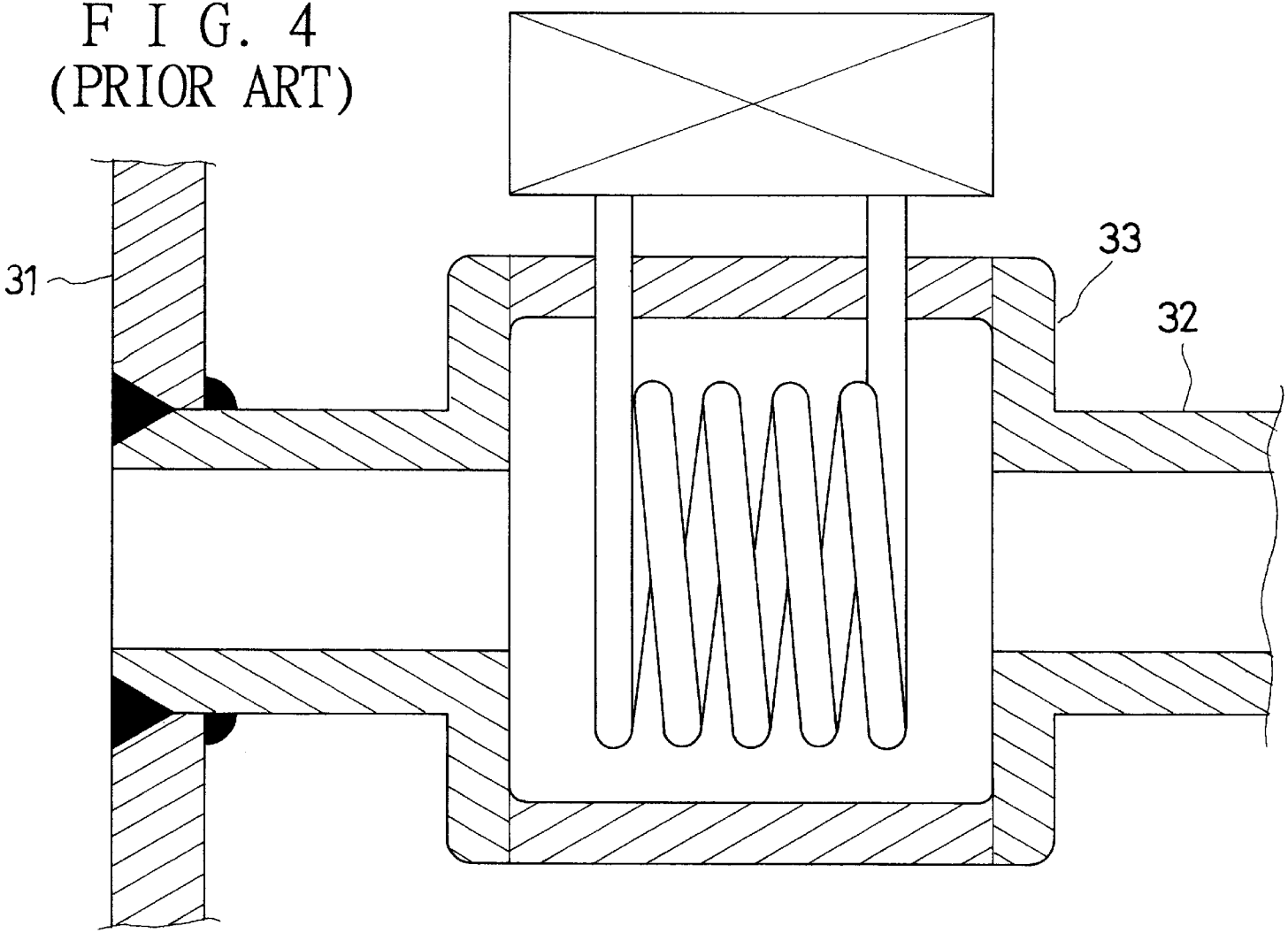
FIG. 4 (PRIOR ART)
FIG. 4 is a view showing the conventional cooling device in respect of the position thereof relative to the hyperbaric oxygen chamber.

Referring to FIGS. 1, 2, and 3, a preferred embodiment of an air conditioning apparatus of a hyperbaric oxygen chamber in the present invention includes an indoor cool air supplier 2, which consists of a housing member 21, a revolving member 22, an axial flow fan 23, air inlets 24, and a cooling device 25. The indoor cool air supplier 2 is disposed inside a hyperbaric oxygen chamber 1.

The revolving member 22 is of an air-actuated kind, and is connected to the axial flow fan 23 and disposed in the upper portion of the housing member 21. The air inlets 24 are arranged under the axial flow fan 23. The cooling device 25 is arranged behind the air inlets 24. Thus, when the revolving member 22 is working to cause the axial flow fan 23 to revolve together with it, the axial flow fan 23 will force air inside the chamber 1 to travel to the cooling device 25 via the air inlets 24, and in turns, the air is made cooler by means of the cooling device 25, and then travels out of the housing member 21. Consequently, the space inside the hyperbaric chamber 1 is cooled down.

From the above description, it can be easily understood that the air conditioning apparatus of the present invention has advantages as followings:

1. It can help keep the air inside the hyperbaric chamber 1 cool throughout use of the chamber 1 because air that passes through the cooling device 25 has been already in the chamber 1. In other words, the present air conditioning apparatus still can function even though air pressure inside the chamber 1 has reached such a level that air can no longer be supplied into the chamber 1.
2. There is no risk of the revolving member 22 producing sparks to cause high concentration oxygen to explode because the revolving member is of an air-actuated kind.

What is claimed is:

1. An apparatus for cooling down air inside a hyperbaric oxygen chamber, the cooling apparatus being disposed inside a hyperbaric oxygen chamber;

the cooling apparatus comprising an axial flow fan and an air-actuated revolving member coupled thereto, the air-actuated revolving member being pneumatically driven for making the axial flow fan revolve so as to force air inside the chamber to travel through a cooling device thereof to be cooled, whereby cooling of air within the chamber is safely maintained.

* * * * *